US007845916B2

(12) United States Patent
Schlosser

(10) Patent No.: US 7,845,916 B2
(45) Date of Patent: Dec. 7, 2010

(54) AXIAL PISTON MACHINE IN SWASHPLATE CONSTRUCTION

(75) Inventor: Robert Schlosser, Waldaschaff (DE)

(73) Assignee: Linde Material Handling GmbH, Aschaffenburg (DE)

( * ) Notice: Subject to any disclaimer, the term of this patent is extended or adjusted under 35 U.S.C. 154(b) by 1067 days.

(21) Appl. No.: 11/543,458

(22) Filed: Oct. 5, 2006

(65) Prior Publication Data

US 2007/0107593 A1 May 17, 2007

(30) Foreign Application Priority Data

Oct. 6, 2005 (DE) ..... 10 2005 047 981

(51) Int. Cl.
*F04B 1/22* (2006.01)

(52) U.S. Cl. ..... 417/269; 92/57; 74/57

(58) Field of Classification Search ..... 417/269; 92/57; 91/499; 74/55, 56, 57, 60
See application file for complete search history.

(56) References Cited

U.S. PATENT DOCUMENTS 3,424,097 A * 1/1969 Hans ..... 74/60
3,641,829 A * 2/1972 Reynolds ..... 74/60
4,111,103 A 9/1978 Mauch
4,637,293 A * 1/1987 Yamaguchi et al. ..... 91/507
5,809,863 A * 9/1998 Tominaga et al. ..... 92/57
5,862,704 A * 1/1999 Seljestad ..... 74/60
6,036,374 A * 3/2000 Fisher et al. ..... 384/621
6,217,289 B1 * 4/2001 Smith ..... 417/199.1
6,287,086 B1 * 9/2001 Steen ..... 417/269
2003/0099552 A1 * 5/2003 Gens ..... 417/269

FOREIGN PATENT DOCUMENTS

DE 2804912 A1 8/1978
DE 4040413 C2 6/1992

* cited by examiner

*Primary Examiner*—Devon C Kramer
*Assistant Examiner*—Leonard J Weinstein
(74) *Attorney, Agent, or Firm*—The Webb Law Firm

(57) ABSTRACT

An axial piston machine (1) has a swashplate construction with work pistons (6) located longitudinally in a cylinder drum (4), each supported by a sliding block (8) on a swashplate (11). The sliding blocks (8) are secured against lifting up from the swashplate (11) by a retaining plate (13) that rotates in rotational synchronization with the cylinder drum (4). The retaining plate (13) is fixed in position in the axial direction by a retaining device (15). The retaining device (15) can be a groove-shaped recess (16) in the swashplate (11), into which the retaining plate (13) can be inserted. Or, the retaining device (15) can be formed by a plate-shaped component (30) inserted into a groove-shaped housing recess (31) on the housing (1), with which the retaining plate (13) can be placed in contact.

7 Claims, 4 Drawing Sheets

AXIAL PISTON MACHINE IN SWASHPLATE CONSTRUCTION

CROSS REFERENCE TO RELATED APPLICATION

This application claims priority to German Application No. 10 2005 047 981.2, filed Oct. 6, 2005, which application is herein incorporated by reference in its entirety.

BACKGROUND OF THE INVENTION

1. Field of the Invention

This invention relates to an axial piston machine that utilizes a swashplate construction with work pistons located so that they can move longitudinally in a cylinder drum and with each piston supported by a sliding block on a swashplate. The sliding blocks are secured against lifting away from the swashplate by a retaining plate that rotates in rotational synchronization with the cylinder drum. The retaining plate is fixed in position in the axial direction by a retaining device.

2. Technical Considerations

DE-OS 28 04 912 describes an axial piston machine in which the retaining plate is secured in the axial direction by a retaining device in the form of a hold-down ring. The hold-down ring is, in this case, screwed onto the swashplate. However, a retaining device of this type, which is realized in the form of a hold-down ring screwed to the swashplate, requires a high level of design and construction effort and complicates the assembly of the axial piston machine.

DE 40 40 413 C2 also describes a generic axial piston machine. In this axial piston machine, the retaining plate is secured in the axial direction by a retaining device in the form of a retaining ring. The retaining ring is provided with radial lugs that can be brought into a functional connection with corresponding lugs on the housing. This results in a form-fitting connection of the retaining ring to the housing in the manner of a bayonet connection. A retaining device of this type, in the form of a retaining ring that is connected with the housing in the manner of a bayonet connection, also requires a high level of design and construction effort and complicates the assembly of the axial piston machine.

Therefore, it is an object of this invention to provide an axial piston machine of the general type described above but that has a lower degree of design and construction effort and is fast, easy, and economical to assemble.

SUMMARY OF THE INVENTION

The invention teaches that, in one embodiment, the retaining device is realized in the form of a groove-shaped recess in the swashplate into which the retaining plate can be inserted. In another embodiment, the retaining device is formed by at least one component, such as a plate-shaped component, which is inserted into a groove-shaped housing recess on the housing and with which the retaining plate can be placed in contact. The invention therefore teaches that the retaining device is integrated into the swashplate or into the housing and is formed by a groove-shaped recess that is formed on the swashplate, into which the retaining ring can be inserted, or is formed by a component that can be inserted in a housing recess and on which component the retaining plate is supported. A recess in the swashplate or a recess in the housing can be provided in any conventional manner. The plate-shaped component with which the retaining plate is in contact can also be manufactured easily. Easy assembly and installation are also possible as a result of the insertion of the retaining plate into the recess or the insertion of the component into the housing recess and the contact of the retaining plate with the component. Compared to known axial piston machines, there is no need for a hold-down ring that is screwed to the housing or a separate hold-down ring that forms a bayonet connection. As a result of which, an axial piston machine of the invention is easier to design, construct, and assemble on account of a lower number of components. The retaining device of the invention is also smaller in the radial direction, as a result of which small radial dimensions of the axial piston machine can be achieved.

In one preferred embodiment of the invention, the recess is formed so that it is open radially inwardly. The groove-shaped recess thereby forms an undercut on the swashplate that is open radially inwardly and into which the retaining plate can be inserted. A recess of this type on the swashplate can be manufactured easily.

It is particularly advantageous if, as in one preferred development of the invention, the recess is provided on the peripheral side with an opening for the installation of the retaining plate. The recess is thus open on the peripheral side, as a result of which the retaining plate can be inserted in the recess with little assembly effort.

In one advantageous embodiment of the invention, the recess can be created in the swashplate by a metal-removing machine, for example in a conventional lathe-turning process. The recess can thus be realized during the lathe-turning of the swashplate, as a result of which the formation of the recess requires little construction effort.

In one advantageous embodiment of the invention, the component can be realized in the form of a stamped or extruded part. The plate-shaped component thereby requires little manufacturing effort.

The housing recess can be realized in the housing from inside or outside, as a result of which the plate-shaped component can be inserted from outside or inside into the recess.

In an additional preferred embodiment of the invention, the groove-shaped housing recess can be manufactured in the housing by a conventional metal-removing process, such as a milling process. The groove-shaped recess can be realized in a simple manner by milling, for example by means of a conventional end milling cutter.

BRIEF DESCRIPTION OF THE DRAWINGS

Additional advantages and details of the invention are explained in greater detail below on the basis of the exemplary embodiments illustrated in the accompanying schematic figures, in which like reference numbers identify like parts throughout.

DESCRIPTION OF THE PREFERRED EMBODIMENTS

Figure 1:
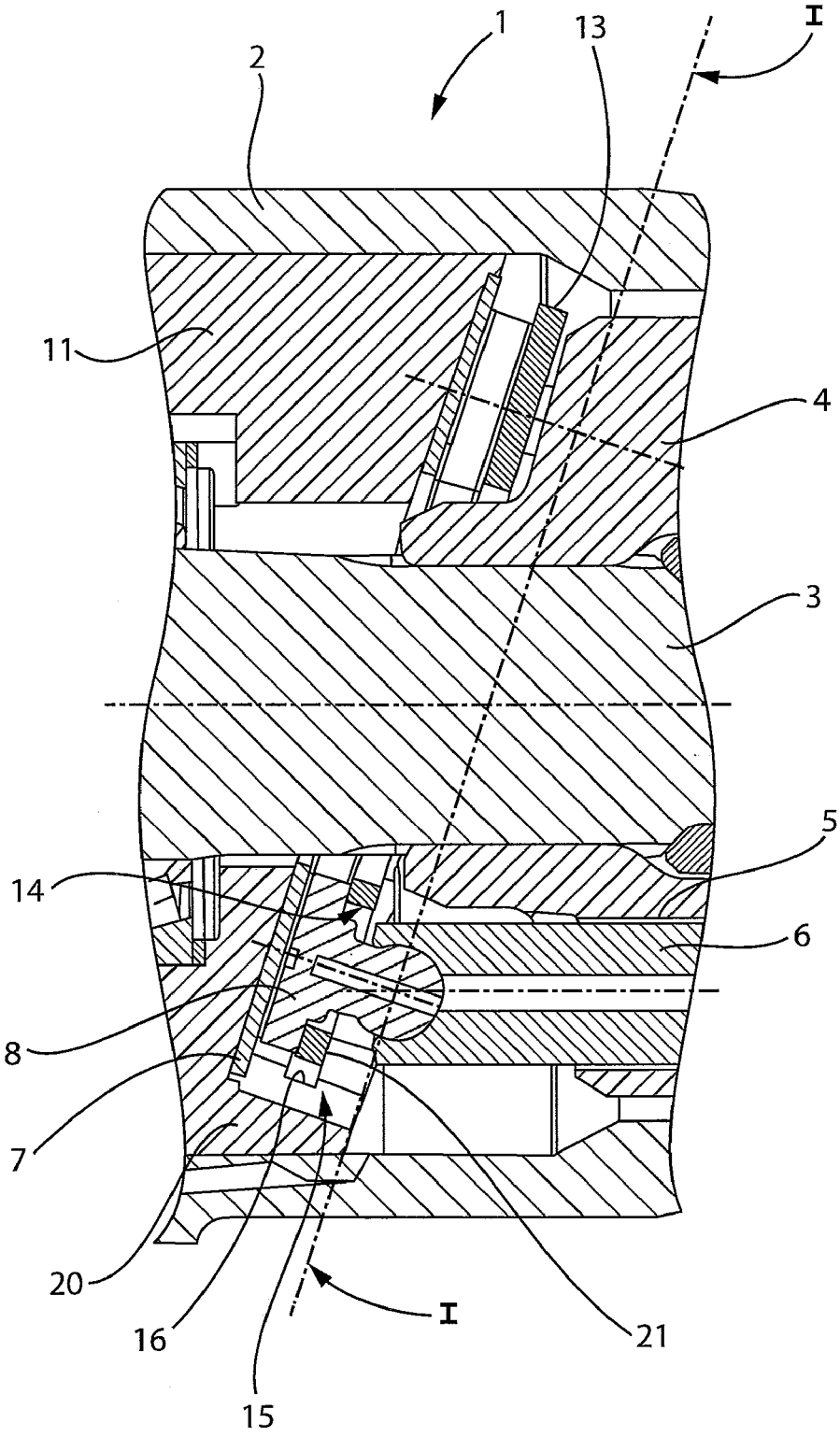
FIG. 1 shows a first embodiment of an axial piston machine of the invention in a longitudinal section.
Figure 2:
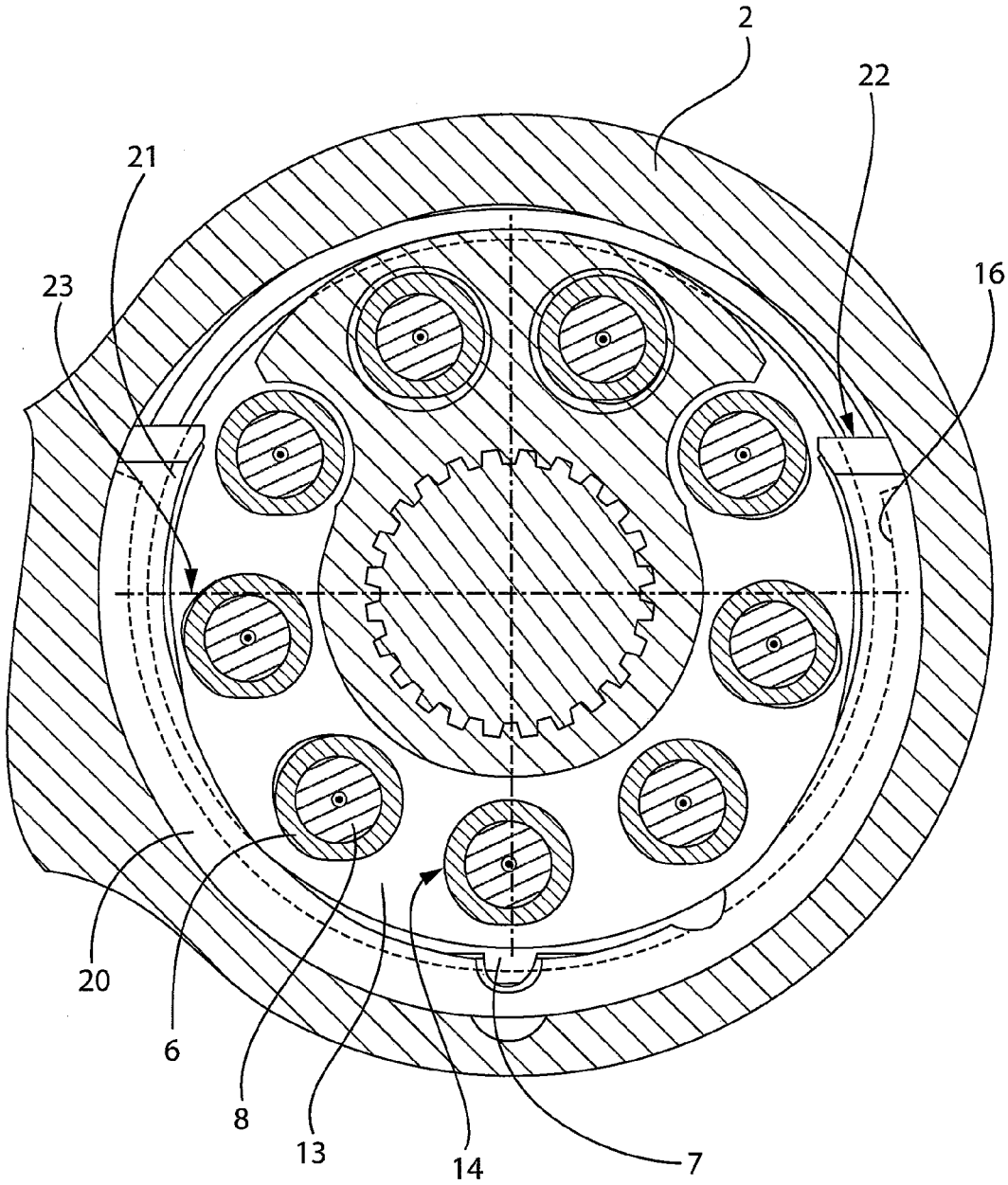
FIG. 2 is a section along line I-I in FIG. 1.

FIGS. 1 and 2 illustrate a first exemplary embodiment of the axial piston 1 utilizing a swashplate construction of the invention.

Mounted in a housing 2 is a drive shaft 3, with which a cylinder drum 4 is non-rotationally connected. The cylinder drum 4 is provided with a plurality of cylinder bores 5, in each of which a work piston 6 is located so that it can move longitudinally.

The work pistons 6 are supported on a swashplate 11 with the interposition of a sliding disk 7 by means of sliding blocks 8 on which the load is reduced hydrostatically. In this example, the swashplate 11 has an inclined surface and is fastened in the housing 2. It is also possible, however, to realize the swashplate 11 directly on the housing 2 and thereby in one piece with the housing 2.

The lifting of the sliding blocks 8 from the swashplate 11 is prevented by a circular ring-shaped retaining plate 13 which is provided with recesses 14 for the sliding blocks 8.

The retaining plate 13 can be fixed in the axial position by means of a retaining device 15 and secured.

The invention teaches that the retaining device 15 can be formed by a groove-shaped recess 16 formed in the swashplate 11, whereby the retaining plate 13 is inserted into the groove-shaped recess 16. The recess 16 can be located on an extension 20 located on the outside periphery of the swashplate 11, which extension 20 extends in the axial direction toward the cylinder drum 4. The groove-shaped recess 16 is realized so that it is open toward the radial inside.

As a result of the eccentric location of the retaining plate 13 with respect to the swashplate 11, the groove-shaped recess 16 has an end side 21 that faces the cylinder drum 4, against which the retaining plate 13 (as illustrated in FIG. 2) is in contact in the vicinity of the longitudinal center plane 23 and, thus, partly with the end side facing the cylinder drum 4, as a result of which the retaining plate 13 is secured axially and fixed in position.

The groove-shaped recess 16 and the extension 20 run in the peripheral direction (as shown in FIG. 2), not over the entire periphery, but end in an area above the longitudinal center plane 23 of the housing 2. In the upper area, therefore, the recess 16 is provided with an opening 22, which makes possible the installation of the retaining plate 13 by the insertion of the retaining plate 13 in the vertical direction into the recess 16.

The recess 16 thereby represents an undercutting of the swashplate 11 that is open in the upper area.

The recess 16 can be produced in a simple manner on the extension 20 during the lathe-turning of the swashplate 11, as a result of which the axial piston machine of the invention requires little construction effort. The insertion of the retaining plate 13 in the vertical direction into the recess 16 provided with the opening 22 also makes possible a simple assembly of the axial piston machine.

By modifying the thickness of the sliding disk 7 or modifying the thickness of the retaining plate 13, the sliding block clearance can be set in a simple manner. The retaining device 15 also has a small radial dimension.

Figure 3:
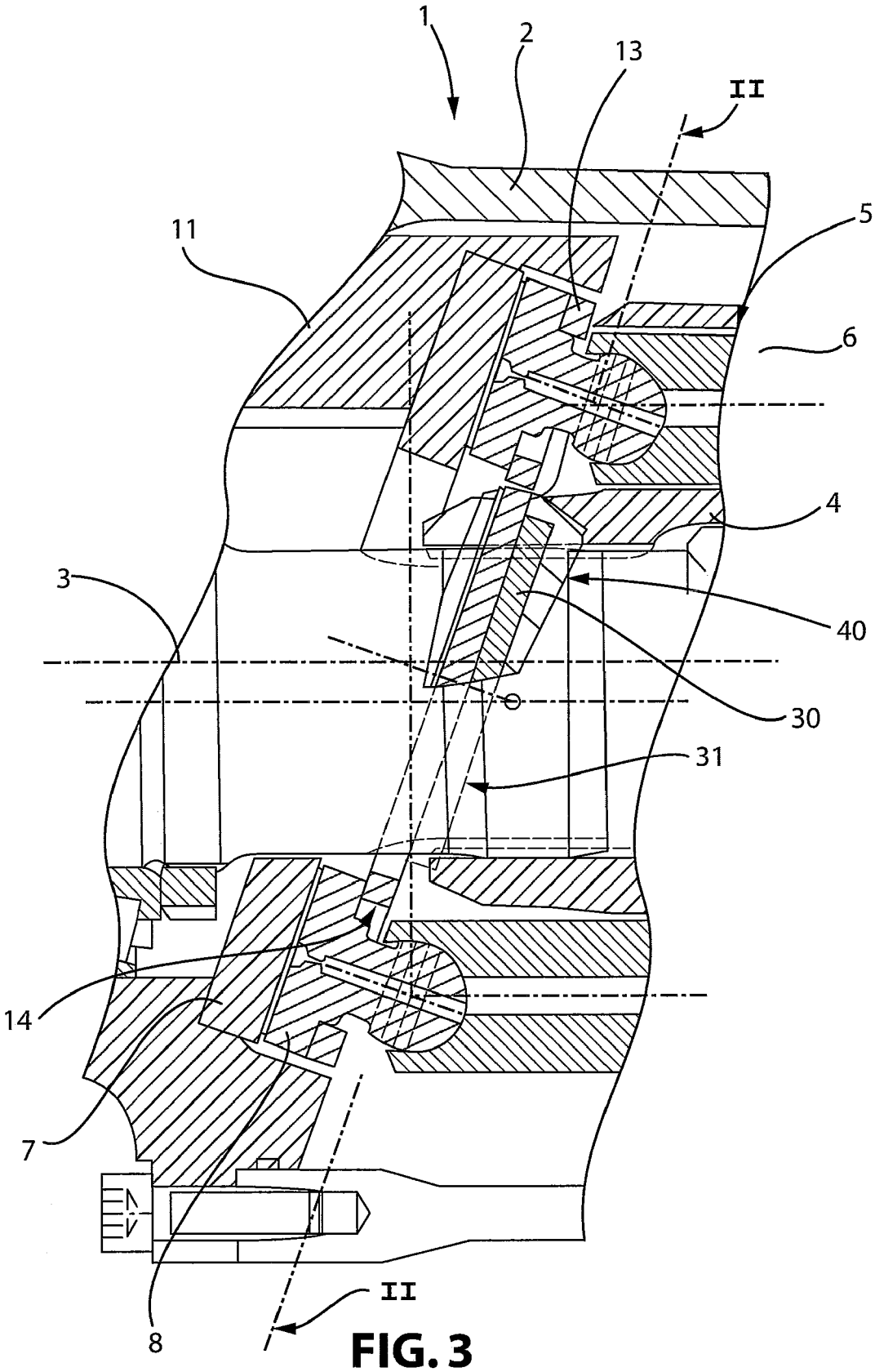
FIG. 3 shows a second embodiment of an axial piston machine of the invention in a longitudinal section.
Figure 4:
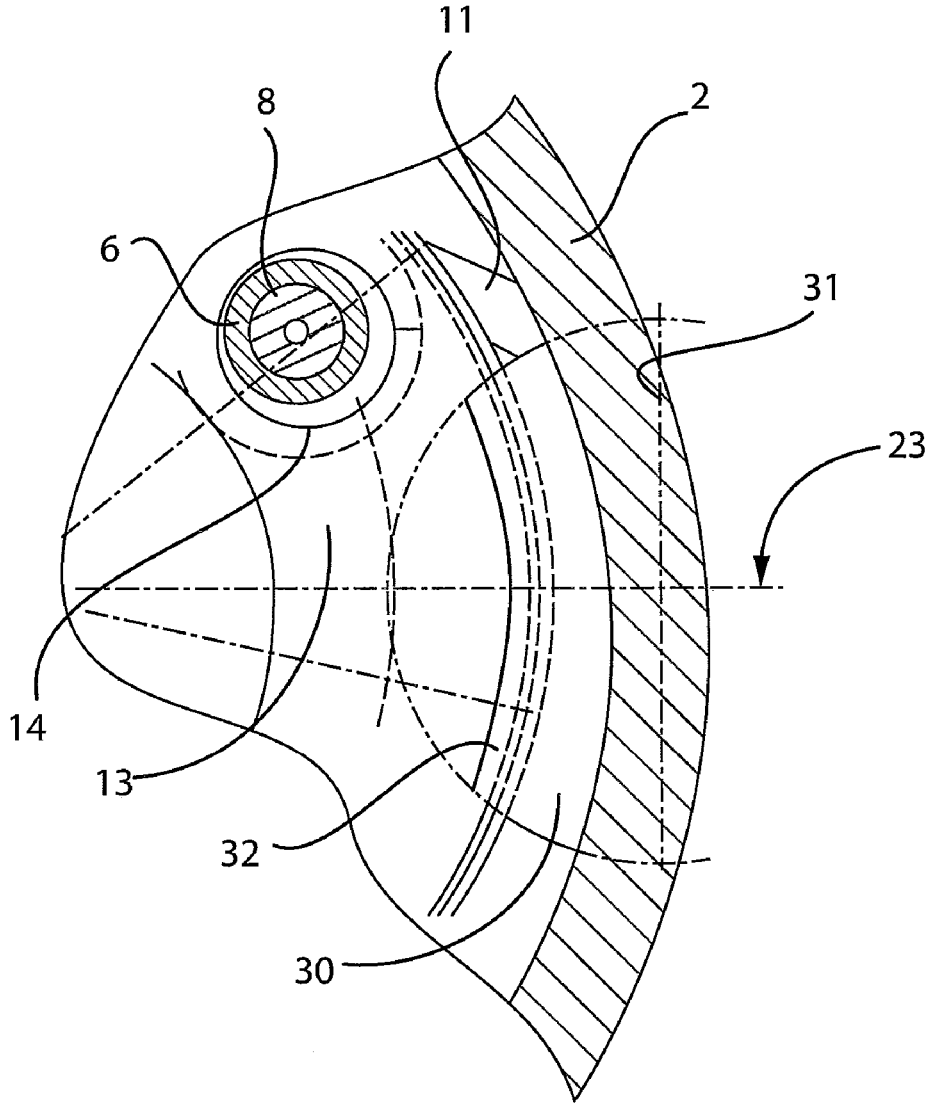
FIG. 4 is a section along line II-II in FIG. 3.

FIGS. 3 and 4 show a second exemplary embodiment of an axial piston machine 1 utilizing a swashplate construction having a retaining device 40 of the invention.

In FIGS. 3 and 4, for the axial fixing in position of the retaining plate 13, the invention teaches that a plate-shaped component 30 is provided, which is inserted into a groove-shaped housing recess 31 that is realized in the housing 1. The housing recess 31 is oriented on the housing 1 parallel to the swashplate 11 and, thus, the retaining plate 13. The component 30 thereby extends radially inwardly into the interior of the housing 1 so that the retaining plate 13 is in contact with the end side facing the cylinder drum 4 in a radially outer area 32 against the corresponding end surface of the plate-shaped component 30.

The housing recess 31 can be created from the inside or from the outside in the housing 1 so that the component 30 can be inserted from the inside or from the outside into the housing recess 31. The housing recess 31 is located in the vicinity of the longitudinal center plane 23.

The housing recess 31 can be manufactured with a side and face milling cutter, for example. The component 30 can be manufactured in the form of a stamped or an extruded part.

The housing recess 31 and the component 30 can be manufactured in a simple manner. The insertion of the component 30 into the housing recess 31 and the axial contact of the retaining plate 13 against the component 30 also make possible an easy assembly of the axial piston machine. The retaining device 40 of the invention also has a small radial dimension.

The sliding block clearance can be easily set by modifying the thickness of the sliding disk 7 or by modifying the thickness of the retaining plate 13.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. An axial piston machine of a swashplate construction, comprising:

work pistons located so that they can move longitudinally in a cylinder drum in a housing, which work pistons are each supported by a sliding block on a swashplate, wherein the sliding blocks are secured against lifting up from the swashplate by a retaining plate that rotates in rotational synchronization with the cylinder drum, wherein the retaining plate is fixed in position in an axial direction by a retaining device, and wherein the retaining device comprises a groove-shaped swashplate recess in the swashplate into which the retaining plate can be inserted, wherein the groove-shaped swashplate recess is located on an extension on an outside periphery of the swashplate, wherein the groove-shaped swashplate recess and the extension do not extend over the entire periphery but are continuous and end in an area above a longitudinal center plane of the housing, and wherein the groove-shaped swashplate recess has an opening configured to allow installation of the retaining plate by insertion of the retaining in a vertical direction into the groove-shaped swashplate recess.

2. The axial piston machine as claimed in claim 1, wherein the groove-shaped swashplate recess is configured so that it opens in a radial direction inwardly from a periphery of the swashplate.

3. The axial piston machine as claimed in claim 1, wherein a peripheral side of the groove-shaped swashplate recess is provided with an opening for installation of the retaining plate.

4. The axial piston machine as claimed in claim 2, wherein a peripheral side of the groove-shaped swashplate recess is provided with an opening for installation of the retaining plate.

5. The axial piston machine as claimed in claim 1, wherein the groove-shaped swashplate recess is formed by lathe-turning of the swashplate.

6. The axial piston machine as claimed in claim 2, wherein the groove-shaped swashplate recess is formed by lathe-turning of the swashplate.

7. The axial piston machine as claimed in claim 3, wherein the groove-shaped swashplate recess is formed by lathe-turning of the swashplate.

* * * * *

UNITED STATES PATENT AND TRADEMARK OFFICE

CERTIFICATE OF CORRECTION

PATENT NO. : 7,845,916 B2
APPLICATION NO. : 11/543458
DATED : December 7, 2010
INVENTOR(S) : Schlosser It is certified that error appears in the above-identified patent and that said Letters Patent is hereby corrected as shown below:

Column 4, Line 54, "of the retaining in a" should read -- of the retaining plate in a --

Signed and Sealed this
Twenty-second Day of March, 2011

David J. Kappos

David J. Kappos
*Director of the United States Patent and Trademark Office*